US006120201A

United States Patent [19]

McKay et al.

[11] Patent Number: 6,120,201

[45] Date of Patent: Sep. 19, 2000

[54] PRINTER WITH FRONT PORTION PROVIDING ACCESS TO PRINT MECHANISM

[75] Inventors: Kerry Neal McKay, San Diego; Mark Arthur Hay, Poway, both of Calif.

[73] Assignee: Hewlett-Packard Company, Palo Alto, Calif.

[21] Appl. No.: 09/351,784

[22] Filed: Jul. 12, 1999

[51] Int. Cl.[7] ..... B41J 29/02

[52] U.S. Cl. ..... 400/691; 400/692; 400/693

[58] Field of Search ..... 400/691, 692, 400/693, 625, 624

[56] References Cited

U.S. PATENT DOCUMENTS

| | | | |
|---|---|---|---|
| D. 379,828 | 6/1997 | Dubson | D18/55 |
| 3,216,021 | 11/1965 | Stefansson | 346/136 |
| 3,611,425 | 10/1971 | Alden | 346/101 |
| 4,641,980 | 2/1987 | Matsumoto et al. | 400/120 |
| 4,642,661 | 2/1987 | Dean, II | 346/153.1 |
| 5,129,751 | 7/1992 | Pillar et al. | 400/692 |
| 5,150,130 | 9/1992 | Sato | 346/76 PH |
| 5,226,743 | 7/1993 | Jackson et al. | 400/625 |
| 5,230,576 | 7/1993 | Sone | 400/649 |
| 5,539,436 | 7/1996 | Wilson et al. | 347/37 |
| 5,730,537 | 3/1998 | Kelly et al. | 400/625 |
| 5,746,528 | 5/1998 | Mayer et al. | 400/625 |
| 5,785,442 | 7/1998 | Hamisch, Jr. et al. | 400/693 |
| 5,868,236 | 2/1999 | Rademacher | 194/217 |

*Primary Examiner*—John S. Hilten
*Assistant Examiner*—Minh H. Chau

[57] ABSTRACT

A low-profile printer includes a main housing portion, a front portion, a media transport mechanism, a print mechanism and a media tray. The front portion is pivotally or detachably secured to the main housing portion. The media tray is positioned inside the main housing portion. In a preferred embodiment, the media transport mechanism and print mechanism are mechanically coupled to the front portion. The media transport mechanism, the print mechanism and the media tray are accessible when the front portion is in an opened position.

18 Claims, 11 Drawing Sheets

PRINTER WITH FRONT PORTION PROVIDING ACCESS TO PRINT MECHANISM

BACKGROUND OF THE INVENTIONS

1. Field of Inventions

The present inventions relate generally to printers and, more specifically, to a low-profile printer with a front portion facilitating access to a print mechanism and/or sheets of printed media.

2. Description of the Related Art

Digitized images are almost ubiquitous in the modern home and workplace. These digitized images include, for example, images generated by word processing, spreadsheet, accounting, drawing and other types of commercially available computer software programs. Data associated with digitized images is also frequently read from storage device, received over telephone lines, downloaded from the internet, etc.

Digitized images of many different formats and from a variety of sources are frequently reproduced and displayed at a computer monitor. Sometimes, it is desirable to generate a printout of an image displayed on such a monitor.

Digitized images are now provided by cable and satellite systems. Such digitized images are frequently viewed, particularly in the home environment, not through a conventional personal computer system, but rather at a television monitor. For example, WebTV Network™ employs telephone lines and a satellite dish to provide an integrated presentation of video programming and various digitized images downloaded from the internet or from other remote sources.

Television monitors are often integrated into an entertainment center or the like. A problem with conventional entertainment centers is that they typically do not include a printer. In some instances, this is simply due to the fact that the component spaces in a typical entertainment center are sized to receive standard sized (e.g., 4½ inches in height) components, such as a conventional Digital Video Disk (DVD) player, but are too small in height to receive a conventional printer. Furthermore, conventional printers are often shaped differently from other components in an entertainment center. Thus, the addition and integration of a conventional printer into an entertainment center, whether in the home or workplace, presents structural as well as aesthetic challenges.

The addition and integration of a conventional printer into an entertainment center presents still other challenges. By way of example, many conventional printers output sheets of printed media at a top surface of the printer. Such a printer is not practical for integration into many entertainment centers because it would be difficult (if not impossible) to retrieve the sheets of printed media without having to pull the printer forward out of the entertainment center.

Another problem with integrating a conventional printer into an entertainment center is access to the print cartridge of the printer. For many conventional printers, it would be difficult or impossible to access their print cartridge without pulling the printers out of the entertainment center.

It would be profoundly inconvenient as well as time consuming to require a user to perform a "gross unstack", i.e., completely remove the printer from an entertainment center, simply to access print cartridges or printed media. Furthermore, this would subject the printer to additional handling thereby increasing the likelihood of damaging the printer and/or its associated cabling.

Thus, a need exists for a low-profile printer suitable for operational as well as aesthetic integration into an entertainment center. Also, a need exists for a printer with a front portion through which a user can easily access a print cartridge of the printer or media printed by the printer without having to pull the printer from its ordinary position in the entertainment center.

SUMMARY OF THE INVENTIONS

A printer in accordance with one embodiment of the present invention has a low-profile that avoids, for practical purposes, the aforementioned problems in the art, and includes a front portion through which a user can easily access a print cartridge and/or printed media.

A printer in accordance with another embodiment of a present invention includes a main housing portion, a front portion, a print mechanism, a printed media receiving surface and a media transport mechanism. The front portion is mechanically coupled to the main housing portion. The print mechanism is adapted to impart indicia onto a piece of media to create a printed piece of media. The printed media receiving surface is inside the main housing and accessible by a user of the printer when the front portion is in an opened position. The media transport mechanism is adapted to move the printed piece of media from the print mechanism onto the receiving surface.

A printer in accordance with another embodiment of a present invention includes a main housing portion, a front portion pivotally secured to the main housing portion and a print mechanism mechanically coupled to an inside surface of the front portion. The print mechanism is accessible by a user of the printer when the front portion is in an opened position.

A printer in accordance with another embodiment of a present invention includes a main housing portion, a front portion, a print mechanism, a media tray and a media transport mechanism. The front portion is mechanically coupled to the main housing portion. The print mechanism is adapted to print on a piece of media and positioned adjacent to a media path within the main housing portion. The media tray is positioned inside and mechanically coupled to the main housing. The media transport mechanism is attached to the front portion and adapted to pick a piece of media from the media tray and advance the piece of media along the media path.

The above described and many other features and attendant advantages of the present inventions will become apparent as the inventions become better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

The following is a detailed description of the best presently known mode of carrying out the inventions. This description is not to be taken in a limiting sense, but is made merely for the purpose of illustrating the general principles of the inventions.

Figure 1:
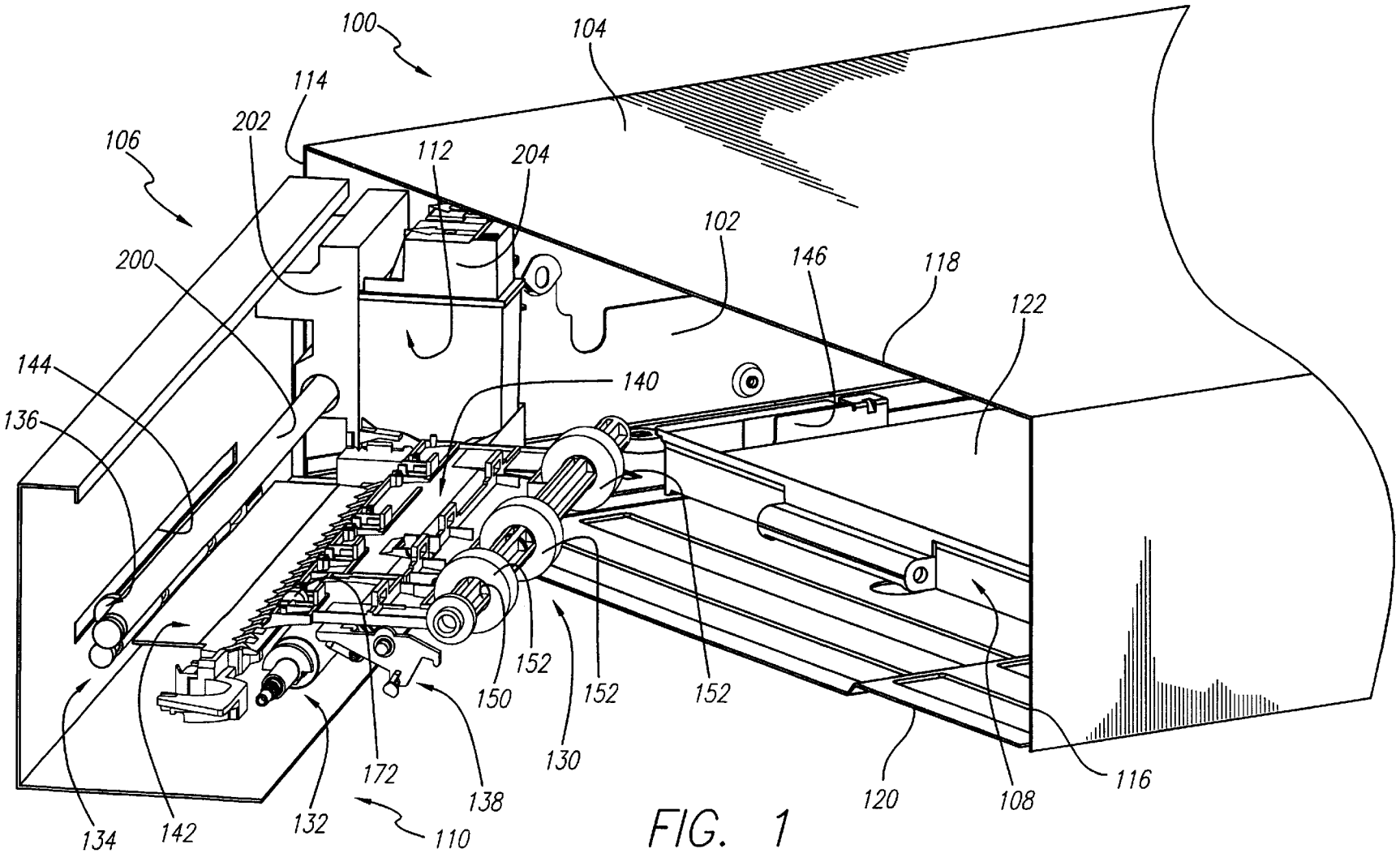
FIG. 1 is a perspective view of a printer in accordance with a preferred embodiment of a present invention.
Figure 2:
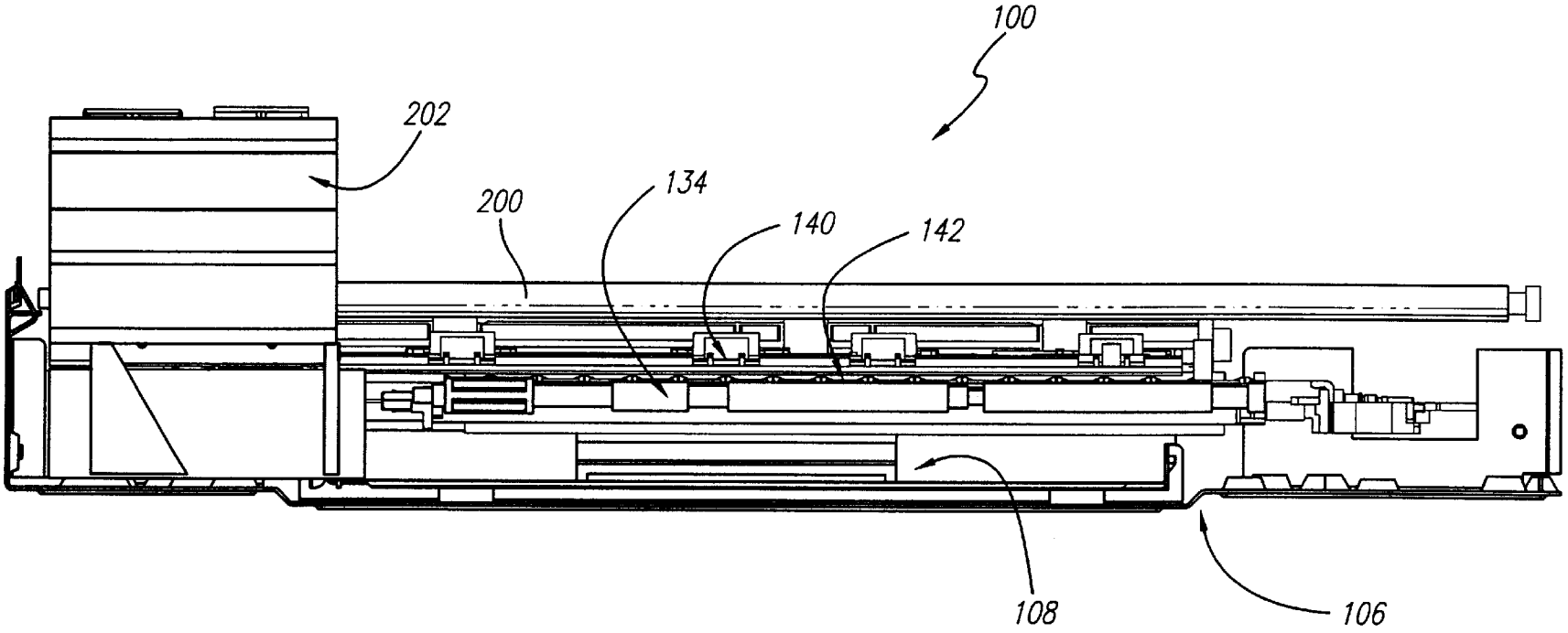
FIG. 2 is a front view of the printer illustrated in FIG. 1 with its housing and front portion removed.
Figure 3:
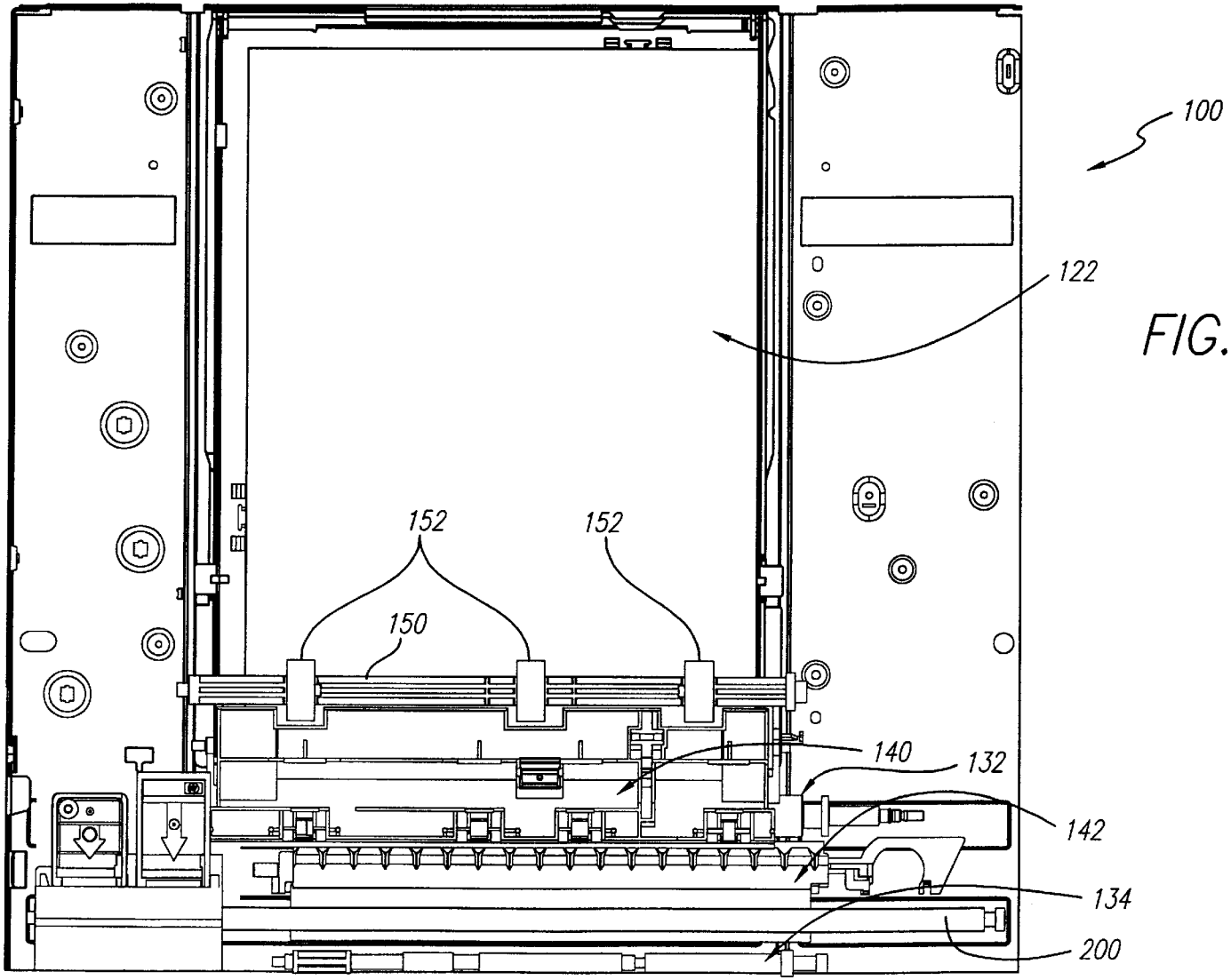
FIG. 3 is a top view of the printer illustrated in FIG. 1 with its housing and front portion removed.

Referring to FIGS. 1–4 and particularly FIG. 1, a printer 100 according to an exemplary preferred embodiment of the present invention includes a chassis 102 that is surrounded by a main housing portion 104 and a front portion 106. The illustrated printer 100 also includes a media tray 108, media transport mechanism 110 and a print mechanism 112.

The main housing portion 104 and front portion 106 are preferably formed from metal and/or plastic materials and sized such that the printer 100 can be fitted into a conventional entertainment center. More specifically, an exemplary preferred printer 100 according to the present invention is formed to be "low profile", i.e., with a height sufficiently small to allow the printer 100 to be fitted within a component space in an entertainment center suitable for standard sized (i.e., 4.5 inches tall) components such as a conventional DVD player or the like. For example, a printer 100 according to the present invention is preferably, but not necessarily, between 3 inches and 6 inches in height.

The front portion 106 of the printer 100 preferably comprises a front panel which is mechanically coupled to the main housing portion 104. In an exemplary preferred embodiment, the front portion 106 is pivotally connected with conventional hinges (not shown) at a side edge 114 of the main housing 104. Alternatively, the front portion 106 can be pivotally connected to the main housing 104 at one of edges 116, 118 and 120. Although a pivotally connected front portion 106 is illustrated, it should be understood that the scope of the present invention additionally includes a printer 100 with a front portion 106 that can be completely disconnected from the main housing 104 via, for example, latches, snap fitting parts or other appropriate securing mechanisms.

In an exemplary preferred embodiment of the present invention, both the media tray 108 and the print mechanism 112 are accessible by a user of the printer 100 when the front portion 106 is in an opened position. Such a configuration advantageously allows the user to load media such pieces of paper 122 into the media tray 108 by simply opening the front panel 106 without having to remove the printer 100 from its position in an entertainment center. With regard to the print mechanism 112, easy access to this mechanism provides the additional benefits of being able to change print cartridges, pens or the like and remove pieces of jammed media without having to remove the printer 100 from its position in an entertainment center.

To this end, both the print mechanism 112 and the media transport mechanism 110 in an exemplary preferred printer 100 are mechanically coupled to the front portion 106. Such a configuration necessarily provides access to both the media transport mechanism 110 and the print mechanism 112 when the front panel 106 is pivoted to its opened position. Since the media transport mechanism 110 and the print mechanism 112 are attached to the front panel 106, the user is also afforded easy access to the media tray 108 when the front panel 106 is pivoted to its opened position.

An exemplary preferred media transport mechanism 110 includes a pick roller 130, a drive roller 132, an output roller 134, a pinch roller 136, a separator mechanism 138, a page guide 140 and a platen 142 assembled as shown. When the front panel 106 is in a closed position, the aforementioned components define a "straight" paper (or media) path between the media tray 108 and a slot 144 formed in the front panel 106. It should be understood that print media of various sizes and types can be accommodated by the media tray 108 and media transport mechanism 110. To this end, the media tray 108 includes a conventional side adjuster mechanism 146. Furthermore, the printer 100 can be provided with an envelope feeder or other mechanisms to accommodate particular sizes and types of media.

In operation, media (such as paper 122) which has been loaded into the media tray 108 are put into contact with the pick roller 130 by either moving the pick roller 130 down to the paper 122 or by raising the paper 122 up to the pick roller 130. For example, a conventional articulating pressure plate (not shown) beneath the media tray 108 lifts a stack of paper 122 in the media tray 108 toward the pick roller 130.

The illustrated pick roller 130 includes a shaft 150 and a plurality of tires 152 secured thereabout. The shaft 150 is preferably made from plastic or metal. The pick roller 130 is driven in a conventional fashion, such as by a stepper motor (not shown) which is mechanically coupled to the shaft 150. The tires 152 are made, for example, from rubber or urethane. In the illustrated straight paper path embodiment, the outer diameter of the tires 152 is preferably no smaller than one (1) inch and no larger than two (2) inches. It has been observed that pick separation generally improves as the outer diameter of the tires 152 is increased due to increased friction between the tires 152 and the sheets of media 122. Although the illustrated pick roller 130 includes three (3) tires 152 spaced along the shaft 150 as shown, it should be understood that the present invention additionally contemplates different quantities, sizes and/or arrangements of tires 152.

In operation, the pick roller 130 turns while the sheets of media 122 are in contact with the tires 152 thereby feeding or advancing the media 122 into the separator mechanism 138. Generally, the separator mechanism 138 functions to separate or "fan out" multiple picks, position a first picked piece of media 122 in contact with the drive roller 132, and restack or "kick back" other pieces of media 122.

Figure 5C:
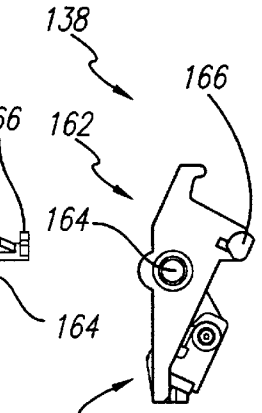
FIGS. 5A–5C are front, top and side views, respectively, of a separator shaft of the printer illustrated in FIG. 1.
Figure 5B:
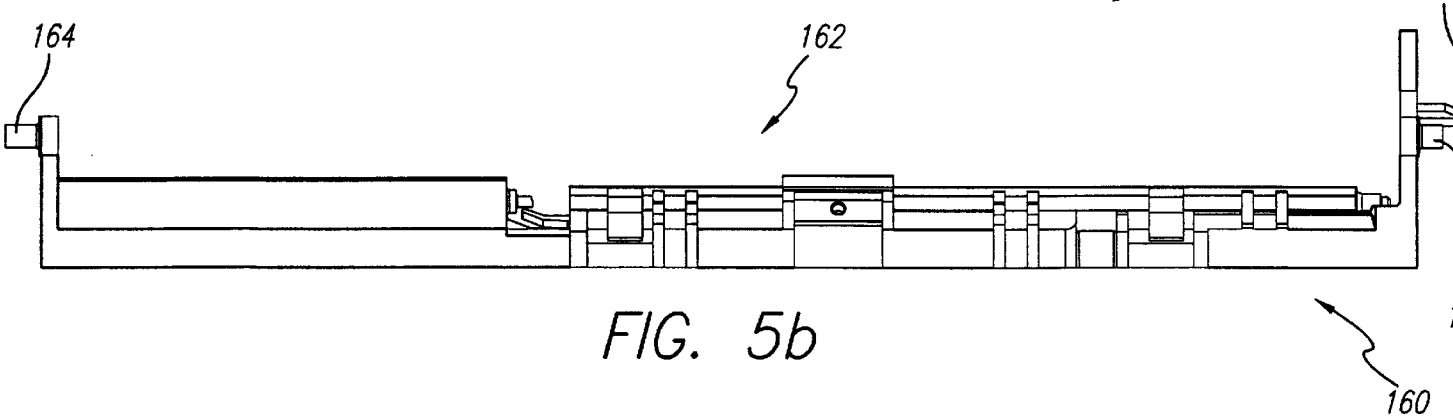
Figure 5A:
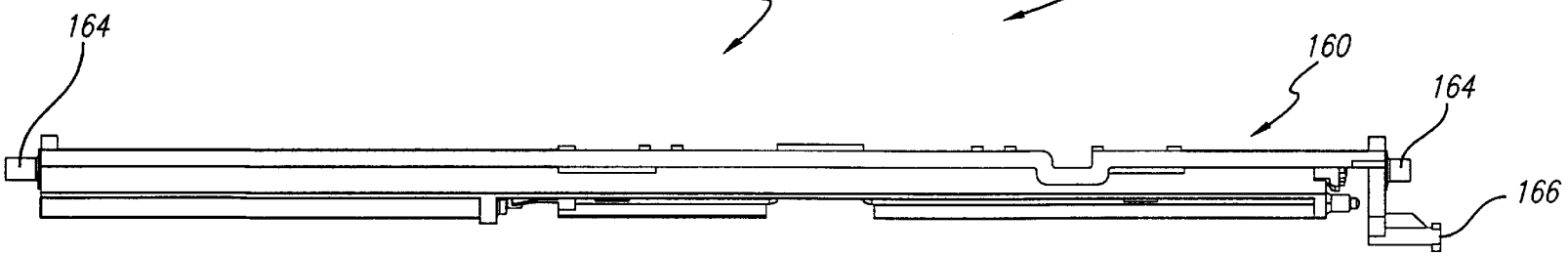

Referring to FIGS. 5A–5C, an exemplary preferred separator mechanism 138 includes a separator shaft 160 with a separator pad 162 formed as shown. The separator mechanism 138 further includes cylindrical members 164 positioned at opposing ends of the shaft 160 and a cantilevered member 166 positioned on the shaft 160 out of the way of the media path. Preferably, the cylindrical members 164 are mechanically coupled to the front portion 106 of the printer 100.

Figure 4:
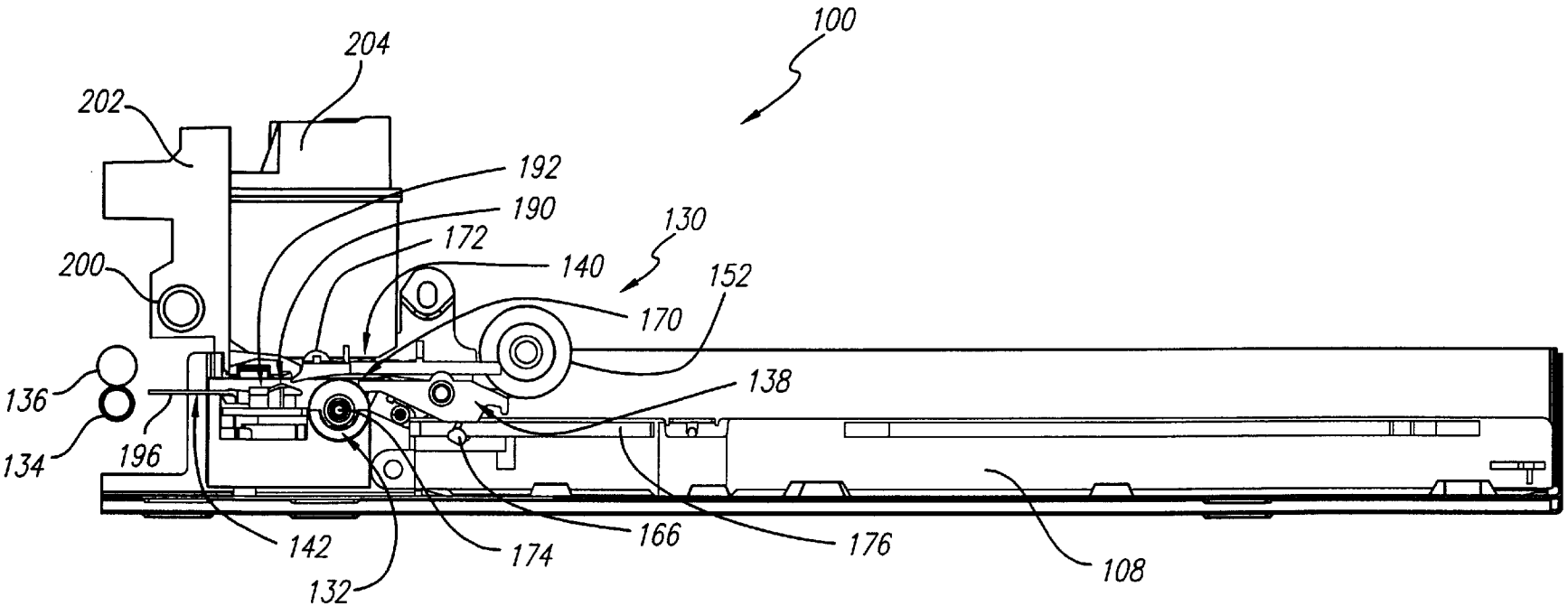
FIG. 4 is a side view of the printer illustrated in FIG. 1 with its housing and front portion removed.

If there are multiple picks, the sheets of media 122 fed into the separator mechanism 138 contact the separator pad 162 at a shallow angle such that the sheets of media 122 tend to "fan out" across the separator pad 162. Referring to FIG. 4, one sheet 122 eventually advances to a nip 170 between the drive roller 132 and a conventional pinch roller 172. In an exemplary preferred embodiment of the printer 100, the drive roller 132 is segmented into a plurality of portions which all rotate about a common axis which passes, for example, through an axis member 174 of the drive roller 132. The axis member 174 is mechanically coupled to the front portion 106 of the printer and driven in a conventional fashion. Each segmented portion of the drive roller 132 has a corresponding pinch roller 172.

The aforementioned segments of the drive roller 132 and their corresponding pinch rollers 172 advance the pieces of media 122 between them and along the media path. The segments of the drive roller 132 are preferably wider than the tires 152 of the pick roller 130 and formed from a harder rubber material, thereby providing more contact surface and greater drive accuracy. The outer diameter of the segments of the drive roller 132 can be significantly smaller than the outer diameter of the tires 152. An exemplary preferred drive roller 132 has an outer diameter as small as 16 millimeter and as large as 25 millimeters. The scope of the present invention additionally contemplates that the outer diameter of the segments of the drive roller 132 can be varied from the aforementioned range and, in particular, increased to provide better friction. However, increasing the diameter will, under many circumstances, necessitate an increase in the height of the printer 100.

The media tray 108 includes a ridge portion 176 which is mechanically coupled to the cantilevered member 166 of the separator mechanism 138. After a piece of media 122 reaches the nip 170, the media tray 108 (and consequently the ridge portion 176) is lowered back down. This articulation of the separator shaft 160 kicks back other pieces of media 122, if any, which made it along with the first sheet 122 onto the separator pad 162. It should be understood, however, that the present invention is not limited to employing a separator mechanism 138 with a separator shaft. For example, a pad which moves back and forth can employed with an independent kicker mechanism for restacking other sheets of media after a first sheet of media reaches the nip 170.

Other approaches to separating sheets of media which are different from the "separator pad" approach can also be employed. A "corner separation" approach employs small, e.g., 45 degree, corners on the input tray so that pieces of media are pushed into the edge of the input tray in a direction toward the pick roller. Each piece of media buckles as it goes over these corners, thereby separating the sheets. This approach is particularly useful where there is little variation in the type or size of the print media.

A "dam separation" approach to separating sheets of media can also be employed. According to this approach, the front wall of the paper tray is formed at a slight angle and with a low friction surface, e.g., stainless steel, which results in separation of the pieces of media.

Figure 7C:
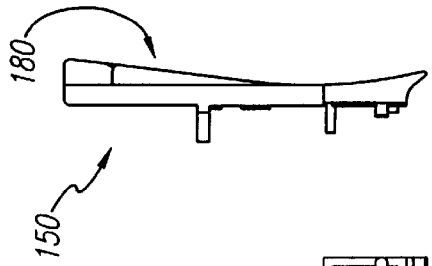
FIGS. 7A–7C are front, top and side views, respectively, of a page guide of the printer illustrated in FIG. 1.
Figure 7B:
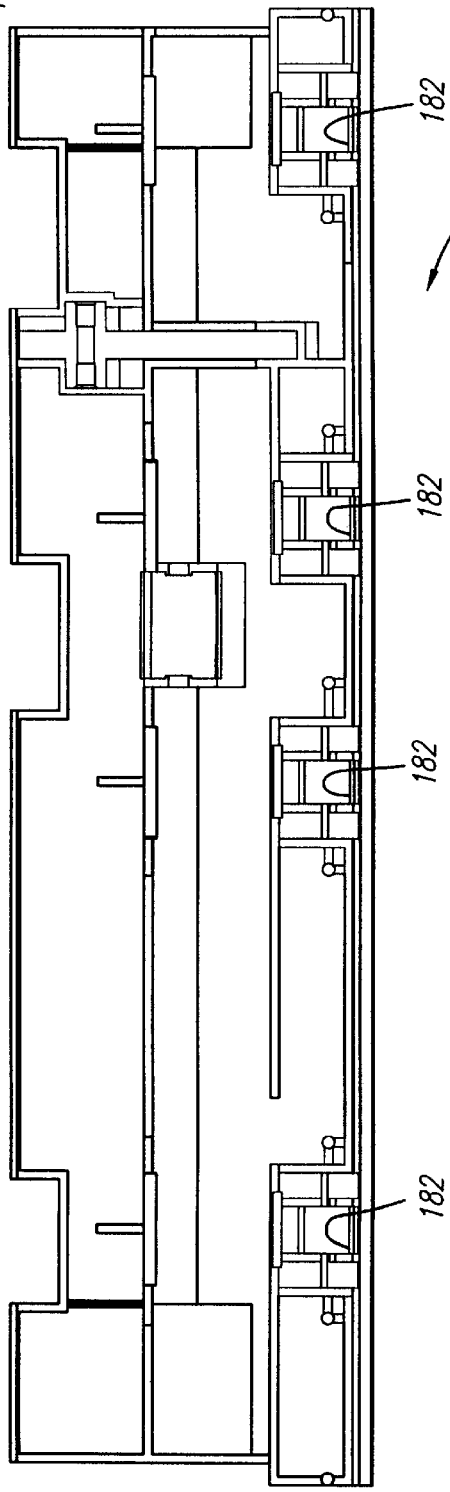
Figure 7A:
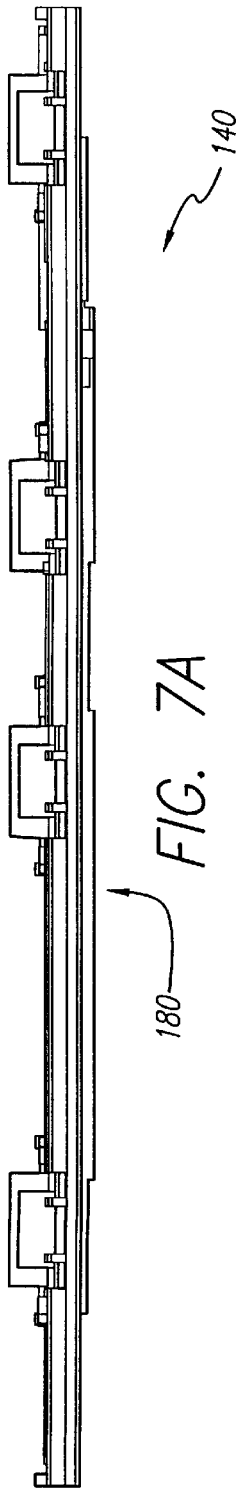

The page guide 140 for the straight media path printer 100 may be formed as shown by way of example in FIGS. 7A–7C. The page guide 140 is preferably, but not necessarily, made from plastic. Referring to FIG. 4, the page guide 140 is positioned above the drive roller 132 in a conventional fashion and functions as an upper boundary against which the pieces of media 122 pass on their way to the nip 170.

Referring again to FIGS. 7A–7C, the page guide 140 includes a lower surface 180 which serves as the aforementioned upper boundary for this "one sided" guide. The page guide 140 also includes apertures 182 for the pinch rollers 172.

Figure 6C:
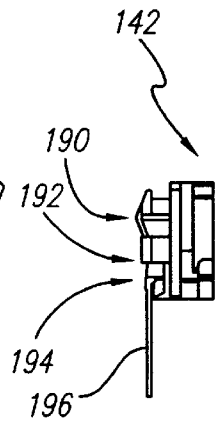
FIGS. 6A–6C are front, top and side views, respectively of a platen of the printer illustrated in FIG. 1.
Figure 6B:
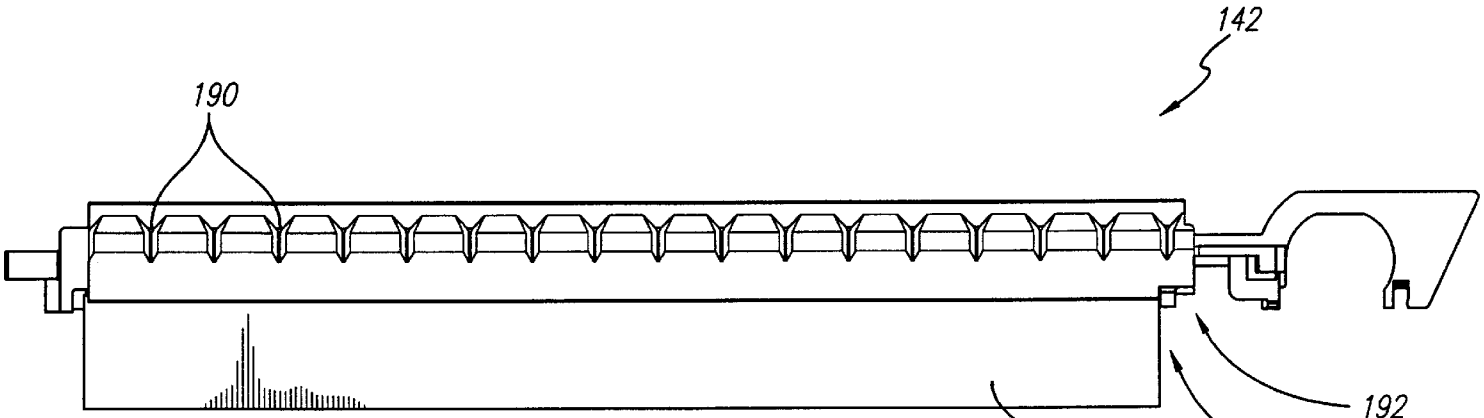
Figure 6A:
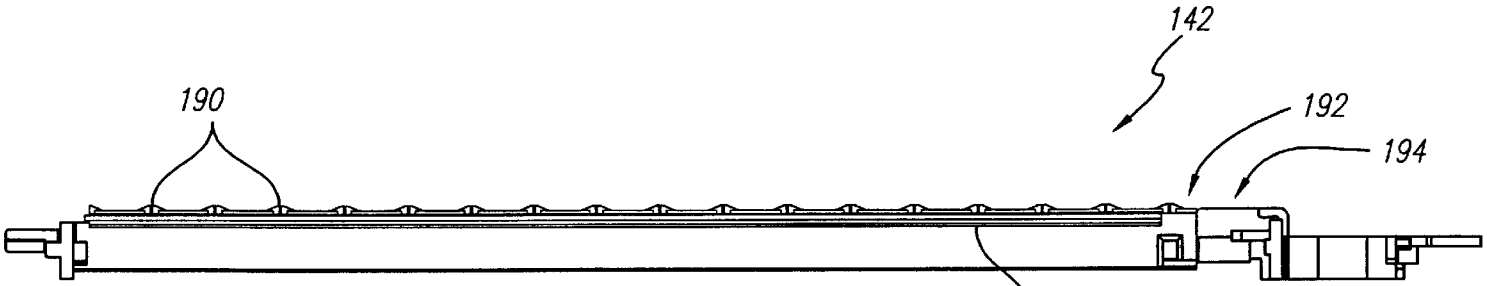

Referring to FIGS. 6A–6C, the exemplary preferred platen 142 for the straight media path printer 100 is formed as shown. The platen 142 is preferably, but not necessarily, made from plastic. Referring to FIG. 4, the platen 142 is positioned between the drive roller 132 and the output roller 134 and beneath the print mechanism 112 in a conventional fashion. Generally, the platen 142 functions to guide the pieces of media 122 from the drive roller 132 to the output roller 134 and to properly position the pieces of media 122 in relation to the print mechanism 112.

Referring again to FIGS. 6A–6C, the illustrated platen 142 includes a plurality of ribs 190 which run substantially parallel to the paper path. Through a series of slight bends, the pieces of media 122 are positioned in a print zone 192 adjacent to a top portion 194 of the platen 142. As the print mechanism 112 imparts indicia onto the piece of media 122 to create a printed piece of media, for example, by laying down swaths of ink in rows across the piece of media 122, the resulting printed piece of media is advanced by the drive roller 132 across a substantially flat, extended portion 196 of the platen 142 toward the output roller 134 and the pinch roller 136. The printed piece of media 122 is pinched between the output roller 134 and the pinch roller 136 and advanced through the slot 144 (FIG. 1) and out of the front portion 106 of the printer 100, preferably into an output tray (not shown). The pinch roller 136 comprises, for example, a conventional star wheel.

Referring to FIG. 1, an exemplary preferred print mechanism 112 includes a slider rod 200, a carriage 202 and an ink cartridge 204. As discussed above, the print mechanism 112 is preferably attached to and supported by the front portion 106. For example, the slider rod 200 is mechanically coupled to opposing side panels (not shown) of the front portion 106. It should be understood, however, that the slider rod 200 can be mechanically coupled to other parts of the front portion 106 or to other parts of the printer 100.

The slider rod 200 provides a track along which the carriage 202 and the ink cartridge 204 reciprocatingly slide (or scan) back and forth during the printing process and under control of a processor (not shown). The carriage 202 is driven to different positions along the slider rod 200 in a conventional manner by a belt mechanism (not shown) or the like.

The processor also controls the actuation or firing of nozzles of the ink cartridge 204 based on the location of the print media 122 along the media path, the position of the carriage 202 over the print media 122 and instructions received from the aforementioned processor which is preferably, but not necessarily, a part of electronics in a printed circuit board (PCB) positioned within the main housing portion 104.

The electronics also provide appropriate control signals to the various motors discussed supra which control and coordinate movement of the pick roller 130, the drive roller 132, the output roller 134 and the pressure plate below the media tray 108. Additionally, the electronics monitor output signals generated by various conventional edge detection sensors and the like for monitoring the position of a piece of media 122 within the printer 100.

Signal interfaces between the aforementioned control electronics, the media transport mechanism 110 and the print mechanism 112 must retain their integrity even though the printer 100 is designed such that the front portion 106 can be opened and closed. To this end, in an exemplary preferred embodiment, at least one wire harness (not shown) provides communication links from the control electronics to the media transport mechanism 110 and the print mechanism 112.

The wire harness can include a portion with detachable connectors. Such a harness is particularly useful in an exemplary preferred embodiment of the printer 100 where the front portion 106 is designed to be completely disconnected or decoupled from the main housing portion 104. Furthermore, the present invention is not limited to wired connections. For example, wireless, optical or other communication links can be employed.

Referring to FIGS. 8–11, a printer 300 according to another preferred embodiment of the present invention is configured to provide a substantially "U-shaped" media path. Components of the printer 300 which are substantially the same as components of the previously described printer 100 are designated with like numerals. Previous discussions of these components are incorporated herein.

The U-shaped media path of the exemplary preferred printer 300 is defined by a media transport mechanism 302 which, in addition to the print mechanism 112, is mechanically coupled to the front portion 106. Such a configuration necessarily provides access to both the media transport mechanism 302 and the print mechanism 112 when the front panel 106 is pivoted to its opened position. Since the media transport mechanism 302 and the print mechanism 112 are attached to the front panel 106, the user is also afforded easy access to the media tray 108 when the front panel 106 is pivoted to its opened position.

Figure 8:
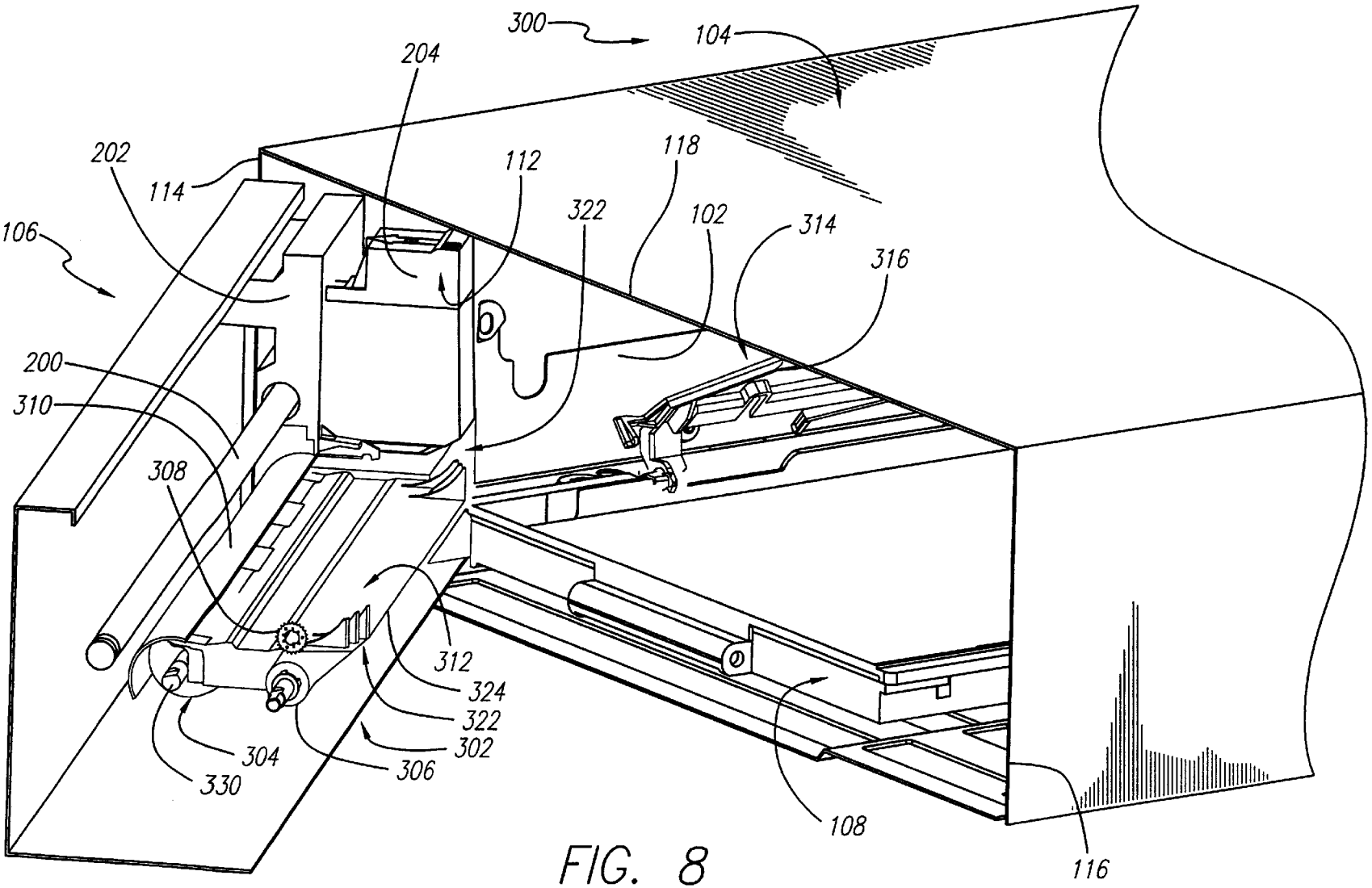
FIG. 8 is a perspective view of a printer in accordance with another preferred embodiment of a present invention.
Figure 9:
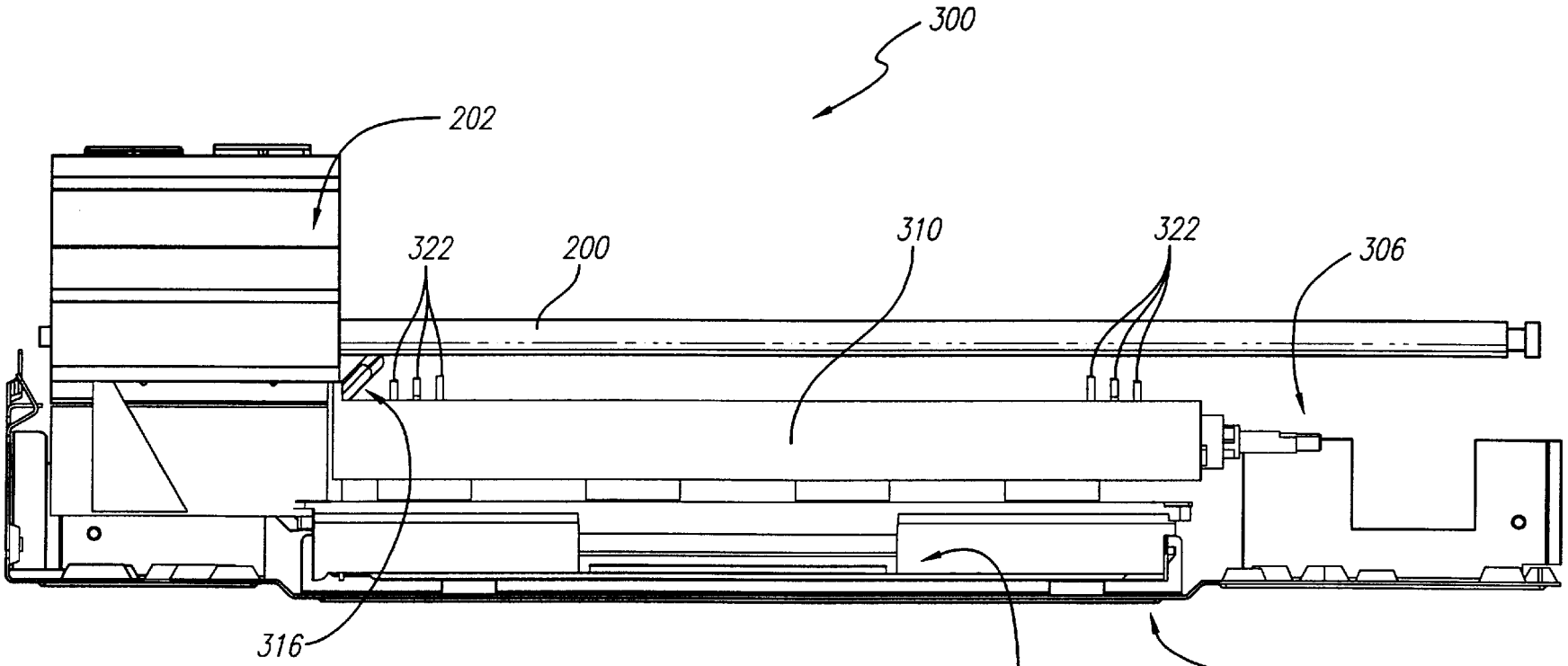
FIG. 9 is a front view of the printer illustrated in FIG. 8 with its housing and front portion removed.
Figure 10:
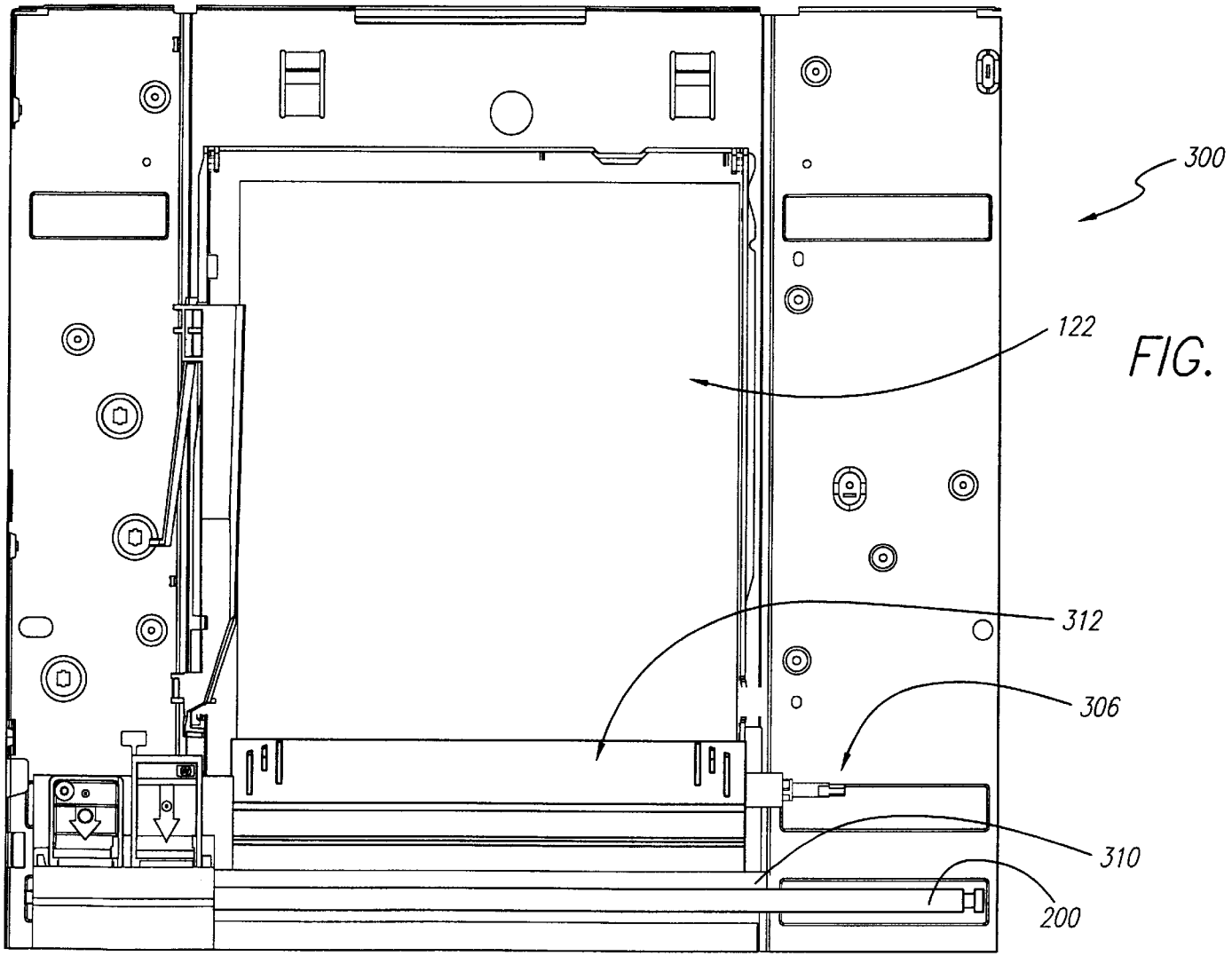
FIG. 10 is a top view of the printer illustrated in FIG. 8 with its housing and front portion removed.

Referring to FIG. 8, an exemplary preferred media transport mechanism 302 includes a separator mechanism (not shown) similar to the separator mechanism 138 shown in FIGS. 5A–5C, a pick and drive roller 304, a kickout roller 306, a pinch roller 308, a page guide 310 and a platen 312 assembled as shown. When the front panel 106 is in a closed position, the aforementioned components define a "U-shaped" paper (or media) path between the media tray 108 and a printed media receiving surface 314 inside the main housing portion 104.

In the illustrated printer 300, the receiving surface 314 is provided by at least one wet stacker wing 316 and/or a top surface (not shown) of the media tray 108. The stacker wing 316 is conventional and preferably positioned as shown within the main housing portion 104 above a side portion of the media tray 108. Alternatively, the receiving surface 314 can be a separate output tray positioned above the media tray 108.

Generally, the media transport mechanism 302 advances pieces of media 122 along the U-shaped media path past the print mechanism 112 to a position above the receiving surface 314. Thus, after a piece of media 122 is printed upon by the print mechanism 112, the front portion 106 can be opened by the user to gain access to the inside of the main housing portion 104 so that the printed piece of media 122 can be lifted from the receiving surface 314 and withdrawn from the printer 300. To this end, and in order to accommodate the close proximity between the pick and drive roller 304 and the front portion 106 in the illustrated printer 300, the position of the media tray 108 within the main housing portion 104 is closer to the front portion 106 as compared to its position in the previously described printer 100.

In operation, media 122 which has been loaded into the media tray 108 are put into contact with the pick and drive roller 304 by either moving the pick and drive roller 304 down to the media 122 or by raising the media 122 up to the pick and drive roller 304. For example, a conventional articulating pressure plate (not shown) beneath the media tray 108 lifts a stack of paper 122 in the media tray 108 toward the pick and drive roller 304.

Figure 11:
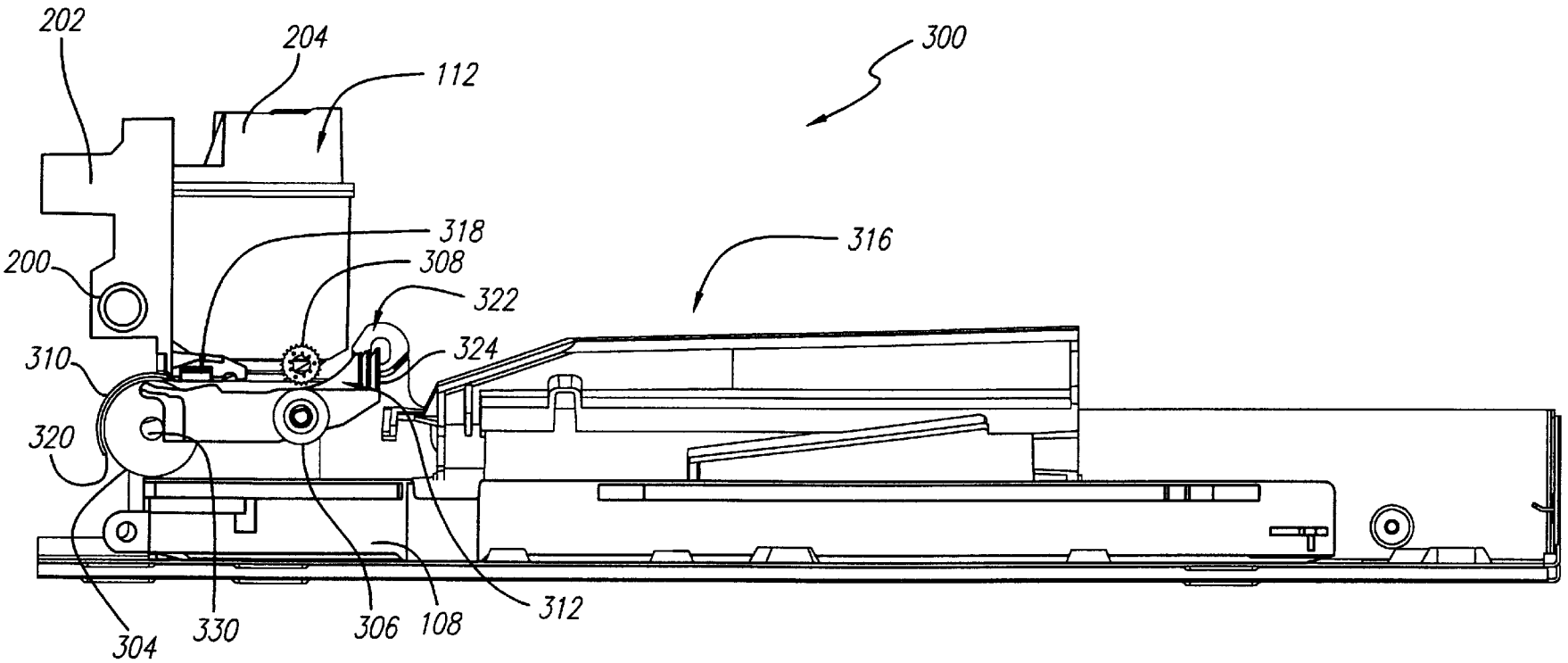
FIG. 11 is a side view of the printer illustrated in FIG. 8 with its housing and front portion removed.

Referring to FIG. 11, once a piece of media 122 is engaged by the pick and drive roller 304, it is advanced around the roller 304 between an outer surface of the roller 304 and an inner surface of the page guide 310. Conventional pinch rollers (not shown) and the pick and drive roller 304 advance the piece of media 122 to a print zone 318 just beyond the edge of the page guide 310 and below the print mechanism 112.

An exemplary preferred pick and drive roller 304 is substantially the same as the pick roller 130, but preferably has an outer diameter of at least one (1) inch.

An exemplary preferred page guide 310 is made as shown from plastic or metal and is positioned around a portion of the pick and drive roller 304. The page guide 310 includes a bottom edge 320 which first receives picked pieces of media 122. The distance between the outer surface of the roller 304 and the inner surface of the page guide 310 is adjusted depending upon the particular application and configuration of the media transport mechanism 302. Furthermore, it should be understood that the page guide 310 can be shaped and positioned in a variety of different ways depending upon the particular application. For example, the page guide 310 should be formed such that the bottom edge 320 of the page guide 310 extends sufficiently close to the location where the pieces of media 122 are first picked by the pick and drive roller 304 to ensure that the pieces of media 122 are advanced properly between the roller 304 and the page guide 310 without jamming and continue along the U-shaped paper path toward the print mechanism 112.

Referring to FIGS. 8 and 11, an exemplary preferred platen 312 is made from plastic or metal and is positioned between the kickout roller 306 and the pinch roller 308. The kickout roller 306 is conventional. The pinch roller 308 comprises, for example, a conventional star wheel.

The platen 312 is shaped to guide the printed pieces of media 122 as they are advanced past the print zone 318 toward the kickout roller 306 and the pinch roller 308. The illustrated platen 312 includes a plurality of banked ridges 322 which are formed near an edge 324 of the platen 312 facing toward the rear of the printer 300. The banked ridges 322 contact the side edges of a piece of media 122 bending the piece of media 122 into the shape of a "smile". This allows the piece of media 122 to cantilever off the platen 312, rather than drag along a previously printed sheet.

An exemplary preferred platen 312 is a "dropping platen" which is pivotally coupled to a shaft 330 about which the pick and drive roller 304 is also positioned. In operation, the platen 312 is rotated downward about the shaft 330 when a piece of media 122 is dropped.

In the exemplary printer 300, the dropping platen 312 is employed in conjunction with a pair of the wings 316. Alternatively, if there are no wings 316, the timing of the various control signals may need to be adjusted to prevent printed sheets 122 from being dropped on previously printed sheets 122 which are still wet. Furthermore, it should be understood that the ridges 322 can be varied in height and/or angle (or completely eliminated) depending upon whether the platen 312 is a dropping platen, whether the wings 316 are present and the desired height of the printer 300 (as ridges 322 of greater height tend to increase the height of the printer 300).

Although the present inventions have been described in terms of the preferred embodiment above, numerous modifications and/or additions to the above-described preferred embodiment would be readily apparent to one skilled in the art. By way of example, but not limitation, variations from the described media paths could be accomplished by employed different media transport and print mechanisms. It is intended that the scope of the present inventions extend to all such modifications and/or additions.

What is claimed is:

1. A printer comprising:

a main housing portion;

a front portion mechanically coupled to the main housing portion;

a print mechanism adapted to impart indicia onto pieces of media to create printed pieces of media;

a printed media receiving surface completely enclosed within the main housing, the print media receiving surface being accessible by a user of the printer when the front portion is in an opened position; and a media transport mechanism adapted to move the printed pieces of media from the print mechanism onto the print media receiving surface.

2. A printer as claimed in claim 1, wherein the print mechanism is accessible when the front portion is in its opened position.

3. A printer as claimed in claim 1, wherein the front portion has a height no greater than 6 inches.

4. A printer as claimed in claim 1, wherein the front portion comprises a front panel pivotally secured to the main housing portion.

5. A printer as claimed in claim 1, wherein the print mechanism is mechanically coupled to the front portion.

6. A printer as claimed in claim 1, wherein the media transport mechanism is mechanically coupled to the front portion.

7. A printer comprising:

a main housing portion;

a front portion pivotally secured to the main housing portion;

a media tray positioned inside and mechanically coupled to the main housing portion;

a media transporter mechanically coupled to the front portion, the media transporter being adapted to operably engage the media tray when the front portion is in a closed position, but not when the front portion is in an opened position, and to pick sheets of print media from the media tray and advance the print media along a media path within the printer; and a print mechanism mechanically coupled to the front portion;

wherein the media tray, the media transporter and the print mechanism are accessible by a user of the printer when the front portion is in the opened position.

8. A printer as claimed in claim 7, further comprising:

a printed media receiving surface positioned within the main housing portion; and wherein the media transporter is adapted to advance the print media to a position above the receiving surface.

9. A printer as claimed in claim 7:

wherein the front portion includes a slot; and wherein the media transporter is adapted to eject the print media from the printer through the slot.

10. A printer as claimed in claim 7, wherein the print mechanism includes an ink cartridge.

11. A printer as claimed in claim 10, wherein the print mechanism includes a slider rod along which the ink cartridge moves during operation of the print mechanism.

12. A printer comprising:

a main housing portion;

a front portion mechanically coupled to the main housing portion;

a print mechanism adapted to print on a piece of media, the print mechanism being positioned adjacent to a media path within the main housing portion;

a media tray positioned inside and mechanically coupled to the main housing portion; and a media transport mechanism including a pick roller and a drive roller, the media transport mechanism being attached to the front portion such that the media transport mechanism is positioned within the main housing portion when the front portion is in a closed position, the media transport mechanism being adapted to pick a piece of media from the media tray and advance the piece of media along the media path.

13. A printer as claimed in claim 12, wherein the print mechanism is accessible by a user of the printer when the front portion is in an opened position.

14. A printer as claimed in claim 12, wherein the media transport mechanism includes an output roller.

15. A printer as claimed in claim 12, wherein the media transport mechanism includes a pinch roller.

16. A printer as claimed in claim 12, wherein the media transport mechanism includes a separator mechanism adapted to separate pieces of media picked from the media tray.

17. A printer as claimed in claim 12, wherein the media transport mechanism includes a page guide.

18. A printer as claimed in claim 12, wherein the media transport mechanism includes a platen.

* * * * *